US005505156A

United States Patent [19]

Briggs

[11] Patent Number: 5,505,156

[45] Date of Patent: Apr. 9, 1996

[54] WINDSHIELD FOR BOATS

[76] Inventor: Joe K. Briggs, Rte. 1, Box 146, Wilcox, Ariz. 85643

[21] Appl. No.: 427,747

[22] Filed: Apr. 24, 1995

[51] Int. Cl.[6] ..... B63B 17/00

[52] U.S. Cl. ..... 114/361; 114/343

[58] Field of Search ..... 114/343, 271, 114/291, 56, 361, 363; 296/84.1, 85, 96.21, 92; D12/300, 314

[56] References Cited

U.S. PATENT DOCUMENTS

| | | | |
|---|---|---|---|
| D. 245,409 | 8/1977 | Bostic et al. | D12/314 |
| D. 271,581 | 11/1983 | Wood et al. | D12/300 |
| 2,102,123 | 12/1937 | Leveau | 114/361 |
| 2,308,109 | 1/1943 | Rundquist | 114/361 |
| 2,836,140 | 5/1958 | Hunt | 114/361 |
| 3,161,895 | 12/1964 | Lewis | 114/361 |
| 3,336,612 | 8/1967 | Stevens | 114/361 |
| 3,810,267 | 5/1974 | Fussell, Jr. et al. | 114/361 |
| 4,957,056 | 9/1990 | Martin | 114/343 |
| 5,121,703 | 6/1992 | Smith | 114/361 |

*Primary Examiner*—Edwin L. Swinehart
*Attorney, Agent, or Firm*—J. Michael McClanahan

[57] ABSTRACT

A windshield for providing protection against wind and water spray for a driver and passengers in open boats of the type having a spaced apart driver's console and passenger's console, the windshield having a first and second panel operably attached to the boat floor situated between the two consoles, rising vertically upward to deflect wind and water spray. The two panels are held together at an angle by a centrally located hinge and secured to the floor of the boat by flexible holding members, the panels further secured by attachment to the consoles through additional flexible holding members attached to the upright sides of the panels. An alternate embodiment provides additional curved windshields attached to the first and second panels which are also attached to and residing above the driver and passenger's consoles respectfully. A second embodiment provides an additional passenger windshield in the event of the absence of the passenger's console, the passenger windshield having a central upright panel with oppositely attached side panels, attached to the floor of the boat by flexible holding members and to the boat windshield second panel through its upright side located flexible holding member.

18 Claims, 2 Drawing Sheets

WINDSHIELD FOR BOATS

BACKGROUND OF THE INVENTION

1. Field of the Invention

The field of the invention is windshields or wind blocking devices attaching to motor boats for protection of driver and passengers against wind and water spray when operating the boat.

2. Description of the Related Art

As pleasure motor boats and commonly boats known as "bass boats" have reached higher and higher speeds (50 to 70 mph is not uncommon), wind and water spray coming over the bow of the boat when traveling at high speeds can be discomforting and possibly painful for the driver and passengers in the boat. As a consequence, on many passenger boats the manufacturers have taken to installing consoles on the boats which has the effect of deflecting the wind and water spray upward and away from the riders. These consoles generally have a somewhat triangular cross-section with one rounded contour surface facing the front of the boat and are typically installed in front of the driver and in front of a passenger seated across from the driver on the other side of the boat. These consoles are usually no wider than a seat. Many boats, if not most, have a driver/passenger compartment with a floor below the top deck level of the boat and in which compartment the seats and consoles of the boats are placed. If the boat has consoles for both driver and passenger, the floor of the compartment takes on a "T" shape. The shank of this "T" shaped section runs towards the front of the boat and seats are across the top portion of the "T". This arrangement allows the boat driver and passengers to sit in the compartment and also to stow equipment in the shank of the "T". Most boats have seats for the driver and passenger with a possible middle seat formed by a removable cushion. The driver sits on one far side with one or more passengers sitting across from or beside the driver.

As mentioned before the consoles provide some protection at low speeds for the driver and far outside passenger from the wind and water spray although a passenger in the center is totally unprotected. However, as boats approach higher and higher speeds, the protection afforded by these consoles is lessened and reaches a point where they are substantially ineffective. Wind and water spray enters the center area between the driver and passenger consoles to adversely affect the riders.

Thus there becomes a need for additional protection from the wind and water spray, especially when the boat is traveling at high rates of speed.

In the past, there have been devices which provided additional protection. For example, Martin, in 1990 U.S. Pat. No. 4,957,056, discloses a transparent windshield for boats which surrounds to effect an enlargement of the driver's console, and which is raised and lowered in position by a electrical actuator. Louis in a 1964 U.S. Pat. No. 3,161,895 and Hunt in a 1958 U.S. Pat. No. 2,836,140 provide a windshield for placement between two spaced apart existing windshields of an enclosed compartment of a cabin cruiser type boat.

Lastly, Runquist in 1943 U.S. Pat. No. 2,308,109, provides a collapsible wind-spray shield for a boat which covers the full front of the boat and is mounted upon the top deck of the boat.

While the above art known to the inventor is useful for the purposes for which they were invented, yet they do not provide a windshield usable in the present style high speed motor boats such as bass boats which are completely open and provide a driver side console and perhaps a passenger side console also.

As wind and water spray impacting on riders becomes increasingly uncomfortable and possibly unsafe at higher speeds, it becomes readily apparent that there is a need for an improved windshield for boats of today's design at high speeds. As a consequence, the need for a device which affords protection to the driver and passenger, including multiple passengers, sitting in the boat is obvious.

SUMMARY OF THE INVENTION

The embodiment of the invention described consists of improvements to motor boats of the type capable of high speeds wherein protection against wind and water spray for the riders is necessary.

More particularly, these improvements comprise a two piece angled windshield which is secured at one end to the floor of the drivers passenger compartment of the boat, the windshield rising up on two sides and attaching itself to the sides of the compartment or to the bases of the driver and passenger consoles as well as the consoles themselves which protrude above the boat deck. This windshield provides complete protection against wind and water spray for any passenger sitting in the center of the boat and against center directed wind and water spray to the driver and passenger.

The device comprises a pair of transparent, somewhat wedge shaped elongated panels adapted to be secured to the floor of the compartment by means of flexible straps attached to the bases of the two panels. At the peripheral edge of the flexible straps are fasteners which mate to their complement attached to the floor of the compartment.

Opposite sides of the panels are respectively attached by similar type fasteners to the vertical sides of the bases which support the two consoles and the two consoles themselves above their bases. When in place, the two panels which form the windshield are held together at an obtuse angle by means of an elongated piano hinge which connects the panels along one of each of their long sides. The base of each panel is angled with respect to its side attached to the hinge, allowing the bases of each panel to fully engage the floor whereby the windshield is angled with respect to the vertical, angling back towards the boat riders. Flexible straps are permanently secured to the elongated distal and opposite sides of the two transparent panels for attachment to the vertical sides of the consoles and their bases. Along the peripheral edge of these flexible straps are situated fasteners adopted to mate with their complement permanently secured to the consoles and their bases.

To make the windshield removable, easily separated snap fasteners are chosen, such as the round cupping female type that frictionally fit over a protruding round male boss. In addition, fasteners may be utilized of the type that present an oval ring of metal which encompasses an upwardly protruding boss, the boss having a top rotatable portion which rotates by ninety degrees to lock the oval ring in place. This latter type fastener is preferably used with the flexible straps attaching the windshield to the floor of the compartment.

When the windshield is not being used, the piano hinge allows both pieces to be pivoted fully such that the two panels are parallel and adjacent to each other, thus occupying minimum space and enhancing carrying of the invention.

In an additional embodiment of the invention for boats without passenger consoles, a passenger windshield is provided for use in combination with the center located windshield previously described, the passenger windshield situated just immediately forward of the passenger. This windshield comprises a somewhat rectangular central transparent panel with two wedged shaped side panels, each side panel attached to the elongated opposite sides of the central panel by piano hinges which run the full length of each side. This passenger windshield is provided with similar type flexible straps at the bases of the central panel and two side panels for attachment to the floor of the compartment.

When the passenger windshield is in place, the two side panels, whose bases are slightly angled from the base of the center panel, are situated so that they are both angled to the central panel and rest completely on the floor of the compartment. This allows the passenger windshield also to rise at an angle from the vertical and towards the passenger. Lastly, along one of side panels of the passenger windshield is a spaced apart series of fastener complements adapted to be engaged by the fasteners situated along the peripheral edge of the flexible strap attached to the primary windshield first described.

In all cases, the flexible straps attached to the panels of both the primary windshield and passenger windshield are held in place by sandwiching the straps in between steel strips and the transparent panels. The steel strips are then held in place by rivets passing through the strip, flexible strap, and panel. In addition, all piano hinges are similarly held to the their respective panels by means of rivets.

Lastly, an alternate embodiment of the invention is presented where the primary centrally located windshield has attached at its upper region two oppositely situated curved transparent wings, the wings having fasteners at their bottom portions. The wings are adapted to encompass the tops i of the driver and passenger consoles, to be held there by the fasteners engaging complimentary fasteners situated along the top of the consoles. By this means, the effective height of the consoles are increased, which, when combined with the centrally located windshield, fully provide complete wind and water spray protection for all riders in the boat.

Accordingly, it is an object of the subject invention to provide means for protecting riders in boats against wind and water spray while the boat is moving.

It is another object of the subject invention to provide a windshield centrally located on the floor of the rider compartment of a boat which shields the driver and passenger against wind and water spray coming through the central area of the boat.

It is still another object of the subject invention to provide a centrally located windshield in a boat which provides additional protection against wind and water spray by providing enhanced shielding over the console of the driver and passenger.

It is still further another object of the subject invention to provide, in addition to the centrally located windshield of the boat, a passenger windshield which attaches to the centrally located windshield for wind and water spray protection for the passenger when the passenger does not have a console.

Other objects of the invention will in part be obvious and will in part appear hereafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings where.

In various views, like index numbers refer to like elements.

DETAILED DESCRIPTION OF THE PREFERRED EMBODIMENT

Figure 1:
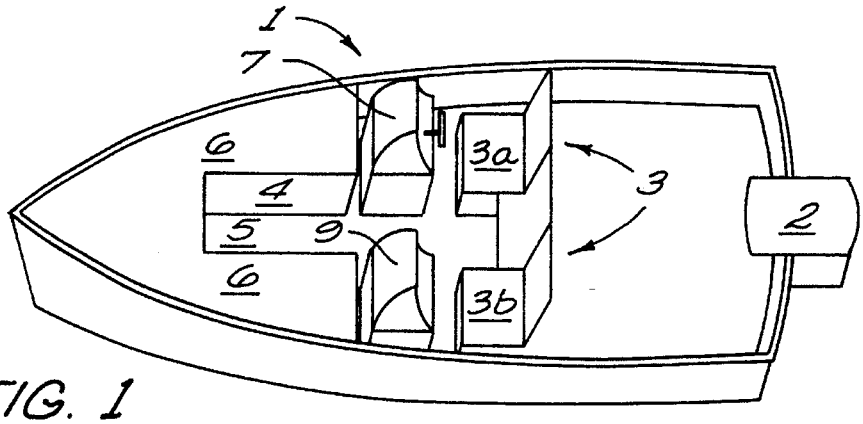
FIG. 1 is a top perspective view of a bass boat showing the rider compartment, the driver and passenger console, and the seating arrangement.

Referring now to FIG. 1, a top perspective view of motor boat 5, such as a bass boat, is shown having as part of its standard construction a seating area 3 divided into two sections, a driver/passenger compartment with floor 5 which takes on a "T" shaped area, a driver's console 7, passenger's console 9, steering wheel 8, and front top deck 6.

The consoles which rise above floor 5 are situated directly forward of the driver's seat (driver's console 7) and the passenger's seat (passenger's console 9). The consoles are contoured upward to deflect wind and driver's console 7, on the portion facing the driver, contains instruments useful to the driver such as the condition of the motor and other pertinent information. The consoles may adjoin top deck 6 or may stand on a base which in turn rests on floor 5. Shown in FIG. 1 are the stand alone types.

Motor boat 1 in the main comes with driver's console 7 although in some cases the passenger's console may be missing. Both consoles are similarly shaped in front appearance, being generally curved upward and back from their base to the rear for the purpose of deflecting wind and water spray over the head of the driver and passenger.

Figure 2:
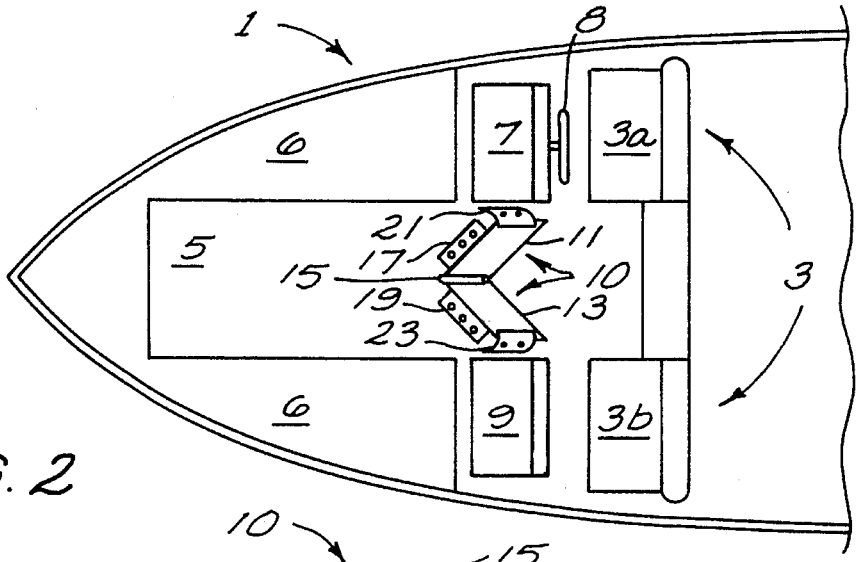
FIG. 2 is a top elevational view of the front portion of a boat with the invention in place.

FIG. 2 is an enlarged top elevational view of the front portion of motor boat 1 with the inventive windshield 10 for boats in place. More particularly, windshield 10 primarily comprises two wedge shaped transparent panels 11 and 13, the panels held together along a respective long side by piano hinge 15, panels 11 and 13 having attached to them flexible holding straps 17 and 19 respectively. These holding straps are for the purpose of securing the panels to floor 5, accomplished by means of a plurality of fasteners . On distal sides of transparent panels 11 and 13 are additional flexible holding straps 21 and 23 which attach to consoles 7 and 9 and their bases respectively.

Inventive windshield 10 is situated in the center of floor 5 between the two consoles and has a height above the consoles. Its purpose is to deflect upward wind and water spray which may impact upon the driver and passenger from the center area, and in the event there should be a second passenger in the space between the seats, to protect this passenger also.

Flexible holding straps 21 and 23 are shown not attached to the consoles nor their bases in order to illustrate the straps more clearly. These straps attach to their respective consoles and bases by means of spaced apart snap fasteners. Windshield 10 is angled at a rather steep angle (70 degrees or so) to floor 5.

Figure 3:
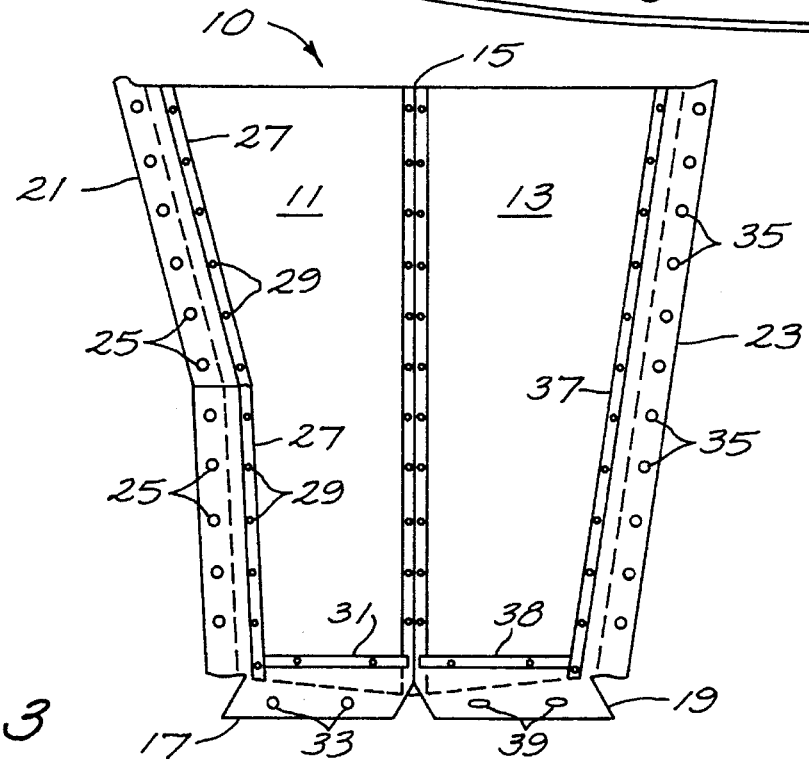
FIG. 3 is a front elevational view of the inventive centrally located windshield separate from the boat.

Referring now to FIG. 3, a front elevational view of windshield 10 is shown as would be seen by a person located at the bow or front of boat 1. Comprising the embodiment of the invention shown in FIG. 3 is firstly left transparent panel 11 and secondly, right transparent panel 13. These two panels, made of clear ⅛" thick plexiglass in the preferred embodiment are somewhat truncated pyramidal shaped or they may be said to be wedge shaped. Along one side edge of each panel is piano hinge 15 which attaches to each panel by the means of spaced apart rivets or the like. Piano hinge 15 allows the relationship between the two panels to be at the angle shown in FIG. 2 when the invention is in place. Along the left hand edge of left transparent panel 11 is flexible holding strap 21 with its plurality of spaced apart fasteners 25 at its peripheral edge. Holding strap 21 comprises in the preferred embodiment a heavy plasticized canvas material, and is held to left panel 11 by sandwiching it between elongated steel strip 27 and panel 11, the three elements held together by means of a plurality of spaced apart rivets 29. It is noted that the left side of transparent panel 11 has been shaped to conform to the base of the driver's console (FIG. 1) as well as the side of driver's console 7 itself.

At the base of panel 11 is shown flexible holding strap 17 which, like holding straps 21 and 23, is made from a heavy plasticized canvas. It is secured along one side to panel 11 by placing it between steel strip 31 and panel 11, all held together by spaced apart rivets. Flexible holding strap 17 is held to floor 5 along its other side by means of spaced apart fasteners 33. The complements or mates to fasteners 33 are attached to floor 5 to complete a hold-fast. Similarly, fasteners 25 situated along the elongated side of panel 11 attach to mating fasteners installed on the driver's console 7 and its base.

Right transparent panel 13 is similarly constructed as left transparent panel 11 having, on its side distal the piano hinge, flexible holding strap 23 with a plurality of spaced apart fasteners 35 along its peripheral edge, flexible strap 23 held to right panel 13 by being sandwiched between steel strip 37 and the panel by rivets. Similarly, at the base of right panel 13 is flexible holding strap 19, held in place by being sandwiched between right panel and steel strip 38 with spaced apart rivets.

As was the case with left transparent panel 11, right transparent panel 13 is secured in place by spaced apart fasteners 35 in flexible holding strap 23 and fasteners 39 in holding strap 19 attached respectively to mating fasteners strategically placed on the passenger console 9 and its base, and floor 5 respectively.

As can be seen in FIG. 3, the edge of transparent panels 11 and 13 (dotted lines) extend slightly beyond the steel strips holding the various flexible straps which secure the panels to the various parts of the boat.

It is noted that the bases of panels 11 and 13 are at an acute angle to the panels edges held by piano hinge 15. This allows windshield 10 robe angled when standing while its bases rest fully on floor 5, thus imparting an angle off vertical to the upright windshield.

In the preferred embodiment of inventive windshield 10, but not limiting the invention in any way, typical measurements of panels 11 and 13 detail a length along the side adjoining piano hinge 15 of approximately 40", bases of approximately 10" each, and a top dimension of approximately 15½" for panel 11 and 16" for panel 13. Windshield 10 typically rises 6" or so above the heights of the driver and passenger consoles.

Figure 4:
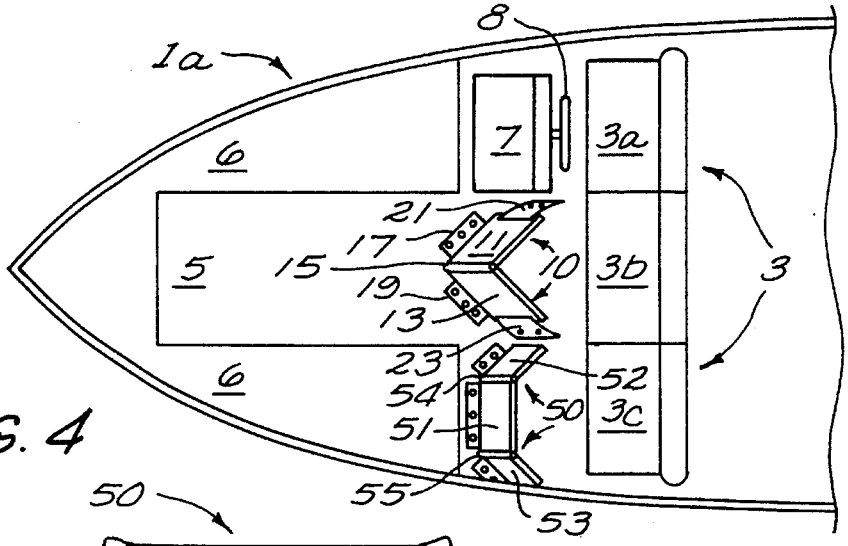
FIG. 4 is a top elevational view of the subject invention enhanced by a passenger windshield when the passenger is not initially provided with a console.

Now it turns out that some motor boats do not have a passenger side console and in such cases, protection against wind and water spray is necessary for the left side passenger seated in seat **3*b*. Adaption of inventive windshield 10 to passenger side windshield 50 is shown in a top elevational view of motor boat la in FIG. 4. In FIG. 4, passenger side windshield 50 is substantially characterized by three panels, namely center transparent panel 51, left transparent panel 55, and right transparent panel 53. These panels are held together by left piano hinge 54 and right piano hinge 55. Passenger side windshield 50 is held to the floor of boat 1*a* by means of separate flexible holding straps attached to the left, right, and center transparent panels respectively. Lastly, left transparent panel 52 is secured to windshield 10 by means of flexible holding strap 23, the same holding strap 23** formerly attached to the passenger side console and its base.

Figure 5:
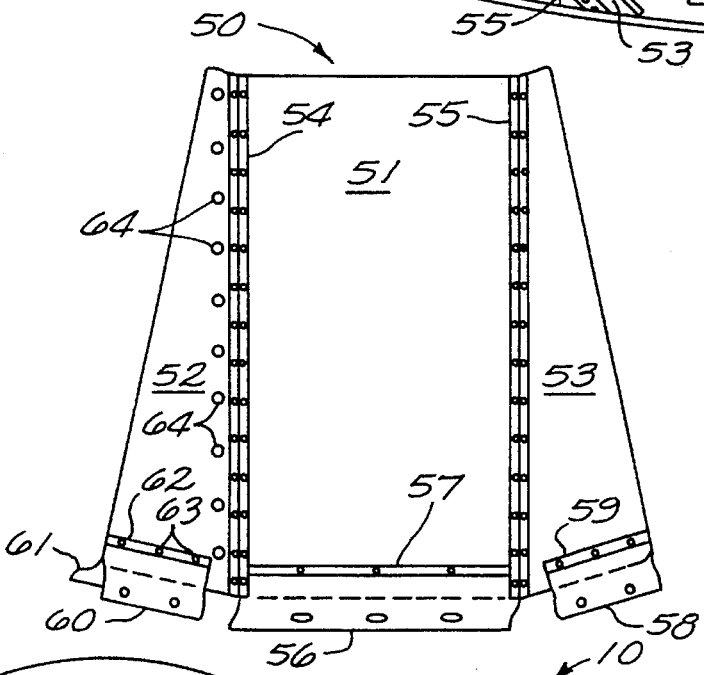
FIG. 5 is a front elevational view of the passenger windshield.

A more detailed view of passenger side windshield 50 is shown in the following FIG. 5. FIG. 5 is a front elevational view of passenger side windshield 50 as one would see if one were to view the windshield from the front of the boat with top deck 6 removed. Dominating FIG. 5 is center transparent panel 51 which in the preferred embodiment is made from ⅛" thick plexiglass or other rigid transparent material and comprises substantially a rectangle in shape. On opposite edges of its two longer sides are continuous piano hinges, left piano hinge 54 and right piano hinge 55. As was the case in windshield 10, these piano hinges run the full length of the sides. Left piano hinge 54 attaches left transparent panel 52 to center transparent panel 51 and right piano hinge 55 attaches right transparent panel 53 to center transparent panel 51. Both piano hinges are attached by spaced apart rivets to the respective panels. At the bases of the respective panels are flexible holding straps, for center transparent panel is center flexible holding strap 56, a heavy plasticized material secured to panel 51 by sandwiching it between steel strip 57 and the panel, all held together with rivets.

On the right hand side of FIG. 5 is shown right flexible holding strap 58 similarly secured to right panel 53 by steel strip 59, the combination being riveted.

Left transparent panel 52 has an additional flexible holding strap to go with left outside holdings strap 60, namely left inside holding strap 61. Outside and inside flexible holding straps 60 and 61 respectively are secured on opposite sides of panel 52 by means of steel strip 62 and its counterpart steel strip (not shown), rivets 63 passing through both steel strips with flexible holding straps 60 and 61 sandwiched in between with the panel in the middle.

As was the case with windshield 10, formed along the outside edge of the flexible holding straps 56, 58, 60, and 61 are a plurality of fastening means, each fastening means adapted to secure with a mating fastener attached to the floor of boat **1*a*. Straps 60 and 61 are situated on opposite sides of panel 52** when secured to the floor.

In order to attach passenger side windshield 50 to windshield 10 when both are used in boat la shown in FIG. 4, fasteners 64 located along the right hand edge of left panel 52 mate with fasteners 35 on flexible holding strap 23. By this means, a complete wind break is presented at the joinder of the two windshields.

In the preferred embodiment of the passenger side windshield shown in FIG. 5, typical dimensions indicate center panel 51 has a length of approximately 40" and a width of approximately 18¼". Transparent panels 52 and 53 each have dimensions of 2" at the top and 12" at the base. It is noted that while the base of center transparent panel 51 is at a substantially right angle with its elongated sides, the bases of left and right panels 52 and 53 are at an angle such as was the case with the bases of the panels which form windshield 10 shown in FIG. 3. By this means, with passenger side windshield 50 installed, center panel 51 rises up from the floor at an angle to the vertical, angled back towards the passenger.

It is intended that when both windshield 10 and passenger side windshield 50 are installed in the boat, the angles between each panel of respective windshield will be such that the full length of the bases of the panels sit upon the floor of the boat and no base is elevated off the floor. In this way, as the wind hits both windshields and exerts pressure downward, the bases of each of the panels are firmly pressed against the floor.

Figure 6:
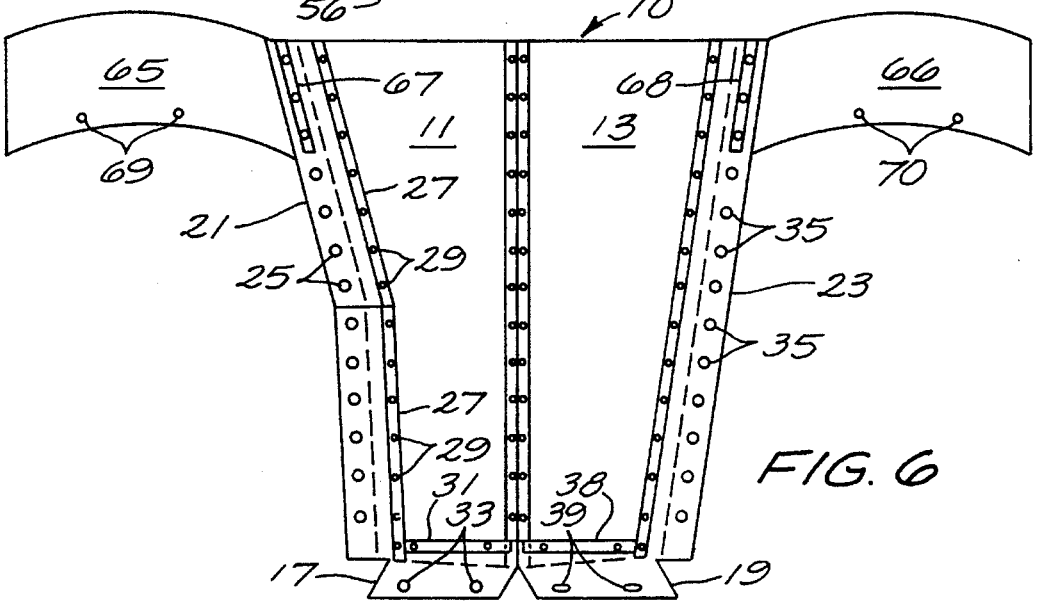
FIG. 6 is a front elevational view of the centrally located windshield with an alternate embodiment providing additional shielding means for the driver and passenger consoles.

An alternate embodiment of the invention shown in FIG. 3 is illustrated in FIG. 6, namely a means for effectively increasing the height of the driver and passenger consoles. More particularly, referring to FIG. 6, a front elevational view is shown of windshield 10 modified to accomplish this purpose. Particularly characterizing the alternate embodiment shown in FIG. 6 are two wings 65 and 66.

In adding the wings to the preferred embodiment the wind and water spray blocking capacity of the consoles are greatly enhanced. Left wing 65 and right wing 65 are curved transparent plexiglass in the preferred embodiment and are attached to flexible holding straps 21 and 23 respectfully of windshield 10 by means of steel strip 67 on the left hand side and steel strip 68 on the right hand side with their associated rivets. Left transparent panel 11 and right transparent panel 13 have been lengthened to receive curved transparent panels 65 and 66 as have the flexible holding straps 21 and 23. At the bottoms of left wing 65 and right wing 66 are spaced apart snap fasteners 69 and 70 respectively. These fasteners attach to their mates situated on the top upper surface of each the driver's and the passenger's console.

All the remaining elements shown in windshield 10 are the same as those described in connection with FIG. 3.

With the addition of curved wings 65 and 66, riding has been made much more comfortable for the driver and passenger, especially when traveling at high speeds.

It is noted that in all the embodiments of the invention shown with piano hinges, each element of each of the embodiments may be folded back on itself to reduce the occupying volume of the invention, and making it easy for storage and transport.

It is apparent that the passenger side windshield may stand by itself on the floor of the open boat to provide protection against wind and water spray on any person who might be behind it, whether a passenger, or a driver in the event that the driver's console be missing, or combination of driver and passengers. The width of the center panel of the passenger side windshield need not be limited.

While the invention has been described, disclosed, illustrated, and shown in certain terms or certain embodiments or modifications which it has assumed in practice, the scope of the invention is not intended to be, nor should it be deemed to be, limited thereby and such other modifications or embodiments as may be suggested by the teachings herein are particularly reserved, especially as they fall within the breath and the scope of the claims here appended.

I claim:

1. A windshield to protect a driver and passengers in open boats that have a driver's console and a passenger's console situated on the floor of the boat immediately forward of the driver and passenger seats respectively, the windshield providing protection against wind and water spray when the boat is moving through the water, the windshield comprising:

a first panel and a second panel situated between the driver's console and the passenger's console, said first panel and second panel operably connected to each other; and holding means operably attached to said first panel and second panel operably securing said first panel and second panel to the boat floor whereby said windshield is secured between the driver's console and passenger's console to deflect wind and water spray coming over the bow of the boat away from the driver and passengers.

2. The windshield for boats as defined in claim 1 wherein said first panel and second panel each have a first side edge and an oppositely situated second side edge, and further including a hinge, said hinge interposed said first panel and second panel, said hinge attached to said first panel at said first side edge and to said second panel at said first side edge, said hinge permitting said first and second panel to be angled with respect to each other.

3. The windshield for boats as defined in claim 2 wherein said holding means operably attached to said first panel and second panel and operably secured to the boat floor includes a first flexible holding member attached to said first panel and second flexible holding member attached to said second panel, and a plurality of two piece mating fasteners, one piece of said plurality of mating fasteners attached to the boat floor between the driver's console and the passenger's console, and the second piece of said plurality of mating fasteners attached to each said first and second flexible holding member whereby said windshield is secured to the floor of the boat by the plurality of mating fasteners.

4. The windshield for boats as defined in claim 3 further including a third and fourth flexible holding member, said third flexible holding member attached to said first panel second side edge and said fourth flexible holding member attached to said second panel second side edge, said third and fourth flexible holding member adapted to be operably secured to the boat.

5. The windshield for boats as defined in claim 4 wherein said third flexible holding member operably attaches to the driver's console and said fourth flexible holding member operably attaches to said passenger's console.

6. The windshield for boats as defined in claim 5 further including a plurality of two piece mating fasteners, one piece of said plurality of mating fasteners attached to the driver's console and the passenger's console, and the second piece of said plurality of mating fasteners attached to each said third and fourth flexible holding member whereby said windshield for boats is further secured to the boat by attachment to the driver's console and passenger's console.

7. The windshield for boats as defined in claim 6 wherein each said first and second panels each define a wedge shape having two elongated sides, a base, and a top, said elongated sides defined by said first side edge and said opposite second edge, and said base of both said first panel and second panel resting upon the floor of the boat, said windshield rising up vertically from the floor of the boat to deflect wind and water spray from the driver and passengers.

8. The windshield for boats as defined in claim 7 wherein each said first and second panels each define a clear, flat, transparent, durable material situated at an angle to each other when secured to the floor of the boat.

9. The windshield for boats as defined in claim 7 further including a first curved windshield and a second curved windshield, said first curved windshield operably attached to said first panel and said second curved windshield operably attached to said second panel.

10. The windshield for boats as defined in claim 9 wherein said first curved windshield is also operably attached to the driver's console, and said second curved windshield is also operably attached to the passenger's console.

11. The windshield for boats as defined in claim 10 wherein said first curved windshield operably attached to said first panel is attached to said third flexible member, and said second curved windshield operably attached to said second panel is attached to said fourth flexible member.

12. The windshield for boats as defined in claim 11 further including means to secure said first curved windshield to the driver's console and means to secure said second curved windshield to the passenger's console.

13. The windshield for boats as defined in claim 12 wherein said means to secure said first curved windshield to the driver's console and means to secure said second curved windshield to the passenger's console define a plurality of two piece mating fasteners, one piece of said plurality of mating fasteners attached to said first curved windshield and to said second curved windshield, and the second piece of said plurality of mating fasteners attached to the driver's console and the passenger's console respectively whereby in addition to the windshield for boats provided between the driver's console and the passenger's console, additional curved windshields are provided attached to the driver's console and the passenger's console.

14. The windshield for boats as defined in claim 13 wherein said first curved windshield sits atop the driver's console and said second curved windshield sits atop the passenger's console.

15. A combined windshield to protect a driver and passengers in open boats that have a driver's console solely situated on the floor of the boat immediately forward of the driver's seat, the combined windshield providing protection against wind and water spray when the boat is moving through the water, the combined windshield comprising:

a central windshield situated on the floor of the boat, said central windshield having a first panel, and a second panel situated juxtaposed the driver's console, said first panel and second panel operably connected to each other;

holding means operably attached to said first panel and second panel operably securing said first panel and second panel to the boat; and a passenger windshield situated on the floor immediately forward the passenger seat, said passenger windshield having a central panel with two elongated oppositely situated parallel side edges;

a left side panel having at least one elongated side edge operably attached to one of said two center panel elongated side edges;

a right side panel having at least one elongated side edge, said right side panel elongated side edge operably attached to the other of said two center panel elongated side edges;

holding means operably attached to said center panel, left side panel, and right side panel, said holding means operably securing said center panel, left side panel, and right side panel to the boat and to said central windshield whereby said central windshield is secured upright proximate the driver's console and is attached to the passenger windshield situated immediately forward the passengers seat so protection against wind and water spray is provided the driver and passengers for open boats without a passenger console.

16. A passenger windshield situated on the floor of an open boat to protect a passenger against wind and water spray when the boat is moving through the water, the passenger windshield comprising:

a center panel having two elongated oppositely situated parallel side edges;

a left side panel having at least one elongated side edge operably attached to one of said two center panel elongated side edges;

a right side panel having at least one elongated side edge operably attached to the other of said two center panel elongated side edges; and holding means operably attached to said center panel, left side panel, and right side panel, said holding means operably securing said center panel, left side panel, and right side panel to the boat whereby protection against wind and water spray is provided a passenger in open boats.

17. The passenger windshield as defined in claim 16 further including a first hinge interposed said center panel and said left side panel, said first hinge attached to said center panel elongated side edge and to said left panel elongated side edge; and a second hinge interposed said center panel and said right side panel, said second hinge attached to said center panel second elongated side edge and to said right side panel elongated side edge, said left side panel and said right side panel angled with respect to said center panel.

18. The passenger windshield as defined in claim 17 wherein said holding means operably attached to said center panel, left side panel, and said right side panel defines flexible holding members and a plurality of two piece mating fasteners, one piece of said plurality of mating fasteners attached to the boat floor, and the second piece of said plurality of mating fasteners attached to said flexible holding members attached to said center panel, left side panel, and right side panel.

* * * * *